United States Patent [19]

Watson

[11] 3,977,541

[45] Aug. 31, 1976

[54] STORAGE STRUCTURE FOR GRANULAR MATERIALS

[76] Inventor: Robert George Watson, 95 Glengowan Road, Toronto, Ontario, M4N 1G5, Canada

[22] Filed: Apr. 17, 1975

[21] Appl. No.: 569,093

Related U.S. Application Data

[63] Continuation-in-part of Ser. No. 437,855, Jan. 30, 1974, abandoned.

[52] U.S. Cl. ..... 214/16 R; 52/197; 52/237

[51] Int. Cl.[2] ..... E04H 7/22

[58] Field of Search ..... 214/16 R, 17 R; 52/193–197, 237

[56] References Cited

UNITED STATES PATENTS

| | | | |
|---|---|---|---|
| 3,124,906 | 3/1964 | Fegles | 214/16 R X |
| 3,207,330 | 9/1965 | Charyn et al. | 214/16 R |

*Primary Examiner*—Robert G. Sheridan

[57] ABSTRACT

A storage unit for granular material has a first wall structure extending upwardly from a base to define connected vertical sidewalls of at least one row of first generally cylindrical bins, and a second wall structure extends upwardly from the base to define at least one row of second generally cylindrical bins spaced apart from and parallel to the first bins. A first hopper is mounted adjacent the lower end of each bin to define the respective bottom ends thereof; and a second hopper is mounted on the vertical wall in a spaced apart relationship above the first hopper to define upper and lower bins, the first and second hoppers each having discharge control means aligned with one another. Each hopper has substantially horizontal load-bearing elements mounted in substantially zero hoop-tension relationship with the vertical walls. Wall openings in each of the vertical walls are aligned with the discharge control means to define a conveyor passageway, and a lower conveyor extends through the passage to receive and convey material discharged from the bins to an outgoing weigh station, an elevator raises material from an in-going weigh station to the bin tops, and an upper conveyor conveys material from the elevator to a selected bin. Cleaners are disposed between opposed vertical sidewalls of the first and second rows of bins and communicate with the upper and lower bins.

10 Claims, 12 Drawing Figures

FIG. 4

STORAGE STRUCTURE FOR GRANULAR MATERIALS

This application is a continuation-in-part of application Ser. No. 437,855 filed Jan. 30, 1974, now abandoned.

This invention relates to the storage of granular material, and in particular to the storage of such materials as grain and the like.

In my copending application Ser. No. 437,856 filed Jan. 30, 1974, now U.S. Pat. No. 3,871,148, I have set out the problems and shortcomings of present existing granular storage structures, such as grain elevators, and proposed a new form of hopper structure which will give storage structures greater land use and efficiency.

In this present application, an alternate form of storage structure is proposed which provides increased operating efficiency and reduced capital costs.

BACKGROUND OF THE INVENTION

In this specification, both with respect to the prior art and the present invention, reference will be made to grain elevators. However, it will be understood that such references will include other equivalent structures as may be employed for storage of other granular materials apart from grain, such as sand, concrete, gravel and the like.

At the present time, grain elevators assume two principal configurations; either a group of silos with a workhouse at one end, or two groups of silos in line with a workhouse in between. Both forms are provided with auxiliary buildings such as track sheds and shipping galleries.

These elevators, as has been mentioned in my copending application, are limited in height due to the structural design structure of the hoppers, and such hoppers as have been described in that copending application will be employed in the structures of this present application.

The usual method of constructing grain elevator silos is by slip-forming. The workhouse is either constructed by fixed forms or by slip-forms, but because of its shape and structural requirements, it needs more costly form work. The total cost of a workhouse is approximately 50% of the total grain elevator or storage structure. If the slip-form method is used, slabs must be formed and supported for pouring. The resultant structure has limited flexibility, particularly since the columnar arrangement required to provide the requisite strength limits the disposition of equipment and makes maintenance difficult.

Another short-coming which arises from the provision of conventional workhouses is the high possibility of explosion damage due to the generation of dust in the building.

A further difficulty with present structures is the awkward, multiple handling which is required to move the grain through the storage facility and accomplish the various cleaning and storage tasks upon the product. Every movement in present structures must be through the workhouse. At the present time, grain moving through a grain elevator requires at least four upward vertical movements by means of bucket elevators or jack legs. Each such movement causes an estimated ½% damage and a total of 2% damage by volume.

Thus, in the prior art, the workhouse is restrictive and inefficient, and grain cannot be received and cleaned in a continuous operation. Also, the standard design of hopper location at the bottom of the silos eliminates any possibility of dividing a silo into stacked bins easily, and the height of bins is restricted because, if bins were higher, the workhouse would be too high.

SUMMARY OF THE INVENTION

It is the main object of the present invention to provide grain elevator structures and the like which will be cheaper to build and more efficient to operate, require less expenditure of work through vertical movement, and consequently have greater efficiency and produce less damage to the product itself. Other objects and features will become apparent. The provision of two spaced apart groups of silos employing the hoppers of my copending application permit silo structures of greater height to be provided and enable cleaning to be accomplished through gravity flow.

The provision of a workhouse between the two groups of silos eliminates a costly expenditure, with less danger. It also provides greater flexibility in handling the products through the storage and cleaning phases.

It is possible to receive and ship simultaneously in both groups; it is possible to receive and clean simultaneously in both groups; and it is possible to ship in one group, and recycle in the other. Also, it is possible to receive, clean and ship simultaneously in both groups.

Space on the cleaning floors allows a complete freedom of orientation of cleaners and workable maintenance space. The number of cleaners may be increased to two per cleaner bin at each level.

More particularly, in accordance with the present invention, there is provided a storage unit for granular material which comprises: a generally planar base structure; a first wall structure extending upwardly from said base to define connected vertical sidewalls of at least one row of first generally cylindrical bins; a second wall structure extending upwardly from said base to define connected vertical sidewalls of at least one row of second generally cylindrical bins, spaced apart from and parallel to said first bins; first hopper means mounted adjacent the lower end of each of said bins to define the respective bottom ends thereof; and second hopper means mounted on said vertical wall in a spaced apart relationship above said first hopper means to define upper and lower bins; said first and second hopper means each having discharge control means aligned one with the other; each said hopper means having substantially horizontal load-bearing elements mounted in substantially zero hoop-tension relationship with said vertical walls; wall openings in each of said vertical walls aligned with said discharge control means to define a conveyor passageway; lower conveyor means extending through said passage to receive and convey material discharged from said bins to an outgoing weigh station; an in-going weigh station; elevator means for raising material from said in-going weigh station to said bin tops; upper conveyor means for conveying said material from said elevator means to a selected one of said bins; and cleaning means disposed between opposed vertical sidewalls of said first and second rows of bins and communicable with said upper and lower bins thereof.

These and other features of the invention will be more apparent from the following description and drawings, in which specific examples are given by way of illustration, and in which.

In this description, the term "conveyor" refers to equipment employed to move material from one point to another in a substantially continuous flow. Belts are preferably employed, although chain or screw conveyors may be employed, depending on the distance or volume.

The term "storage bin" will also be employed to refer to the whole or any divided part of a bin so employed; and the term "upper and lower storage bins" as used in this specification refers to such bins as may be immediately above or below another bin, respectively.

The term "bucket elevator" refers to a continuous vertical belt with metal buckets attached for moving grain vertically. The term "jack leg" refers to a mechanism similar to a bucket elevator but of lesser height.

Figure 1:
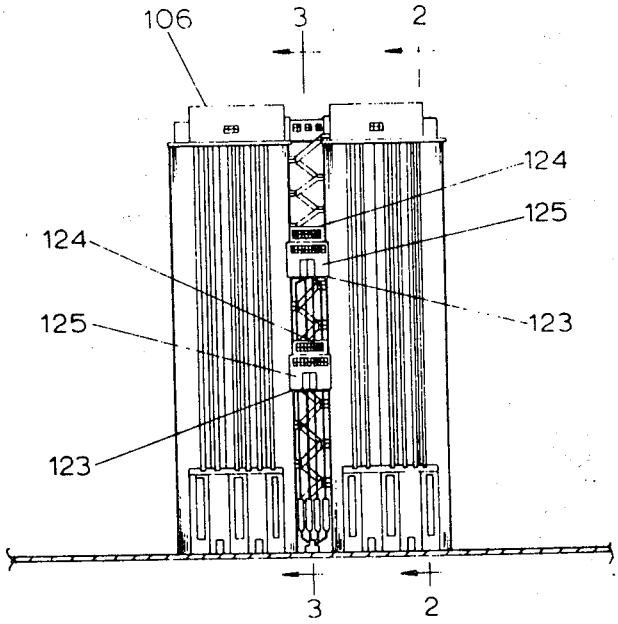
FIG. 1 is an end elevation of one embodiment of a grain storage structure in accordance with the present invention.
Figure 2:
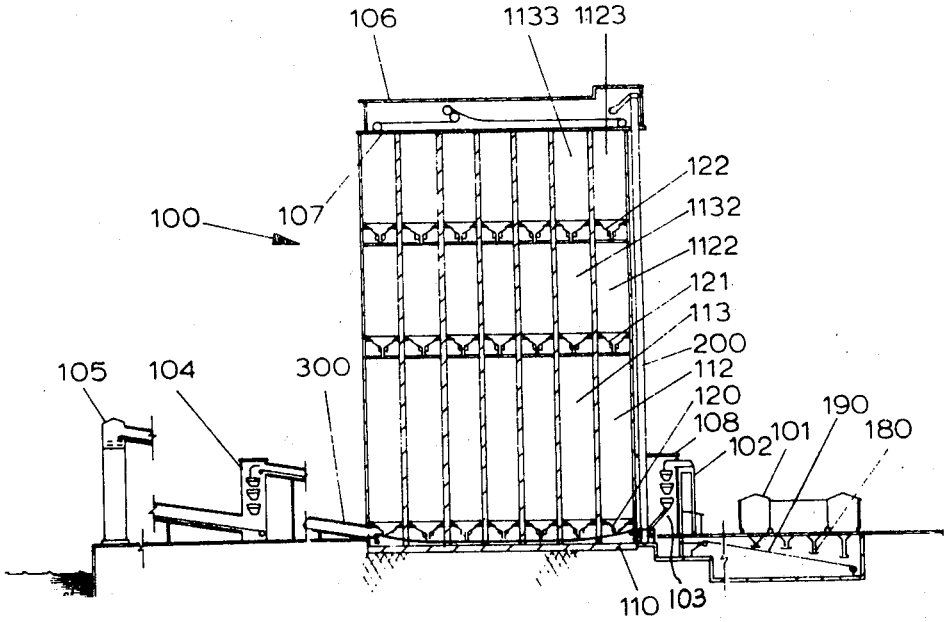
FIG. 2 is a longitudinal elevation taken along 2—2 of the embodiment illustrated in FIG. 1.

Referring now to the drawings, it will be observed from FIG. 2 that the auxiliary buildings to the main storage structure indicated at 100 comprise a track shed 101, jack legs 102, scale house 108 with receiving scales 103, shipping scales 104, a shipping gallery 105 and a cupola 106 mounted atop the bin floor indicated at 107.

Figure 7:
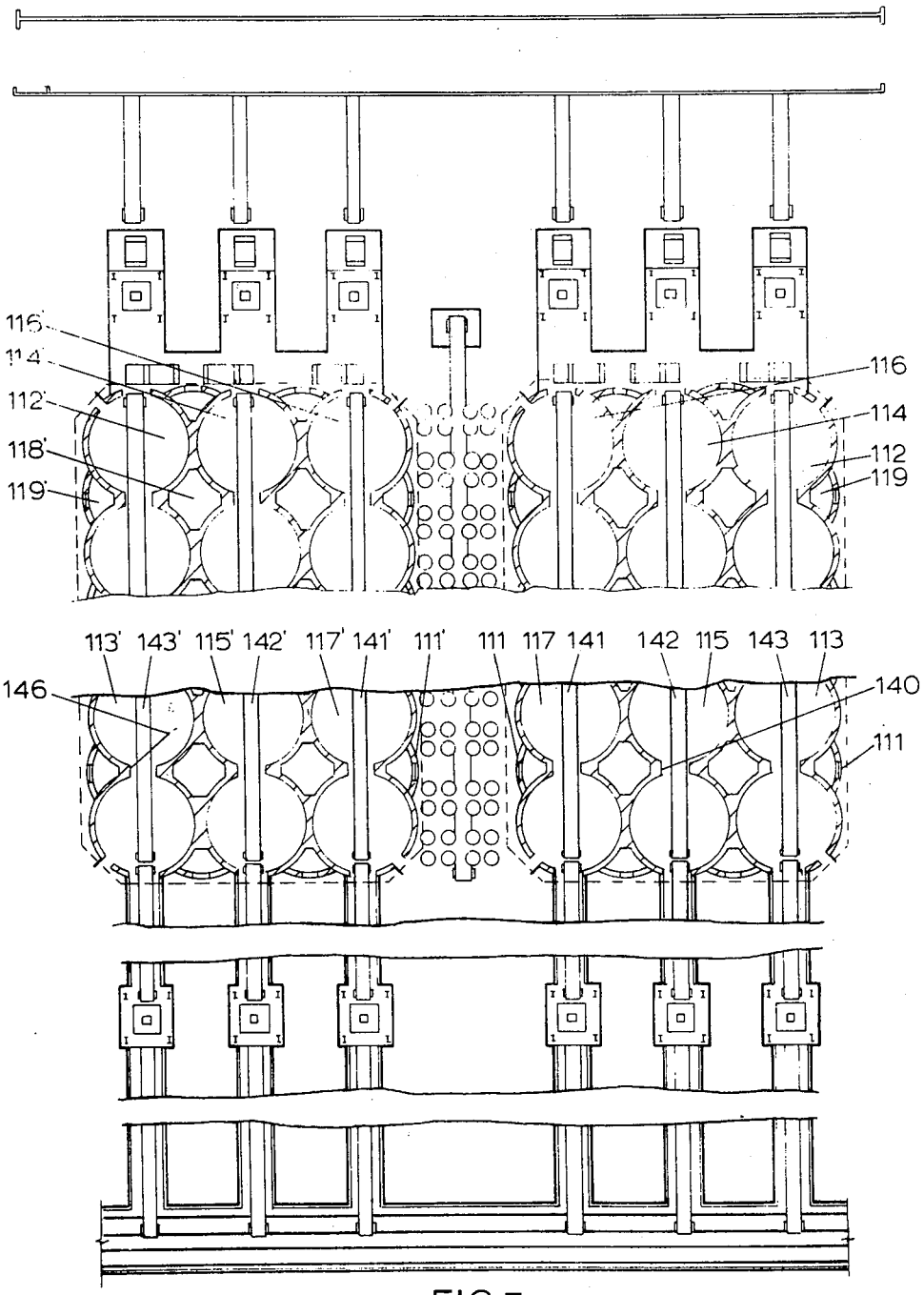
FIG. 7 is a plan view taken along line 7—7 of FIG. 4.

The storage structure 100 comprises a substantially flat pad 110, which is suitably founded, and from which extend vertical walls such as 111 to define a first plurality of rows of vertically extending parallel cylinders such as 112, 113, 114, 115, 116, 117. These cylinder walls also define star bins such as 118 and external interstitial bins such as 119, as shown in FIG. 7. For the purposes of this description, such bins will be included within the term storage bin as previously defined.

Spaced apart from this first plurality of rows of storage bins, a second plurality of rows, which is a mirror image of the first, similarly rises from pad 110. These corresponding storage bins are correspondingly numbered and distinguished by the prime sign, 112′, 113′, 114′, 115′, 116′, 117′, 118′ and 119′.

Adjacent the base of each storage bin, a hopper such as 120 is provided; and vertically spaced apart further identical hoppers 121 and 122 in bin 112 are provided.

Figure 10:
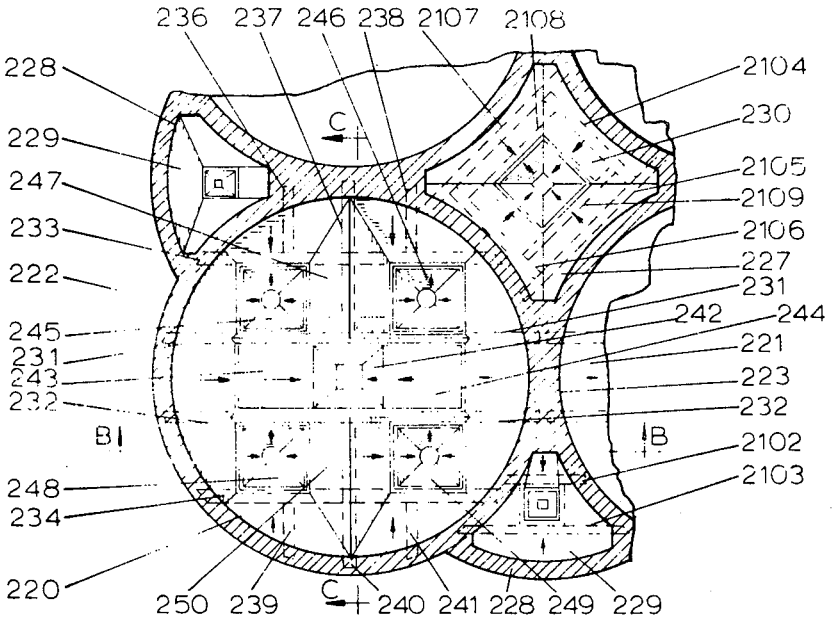
FIG. 10 is a fragmentary enlarged plan view of a bin structure taken along line 6—6 of FIG. 4 and illustrating the hopper structure.
Figure 11:
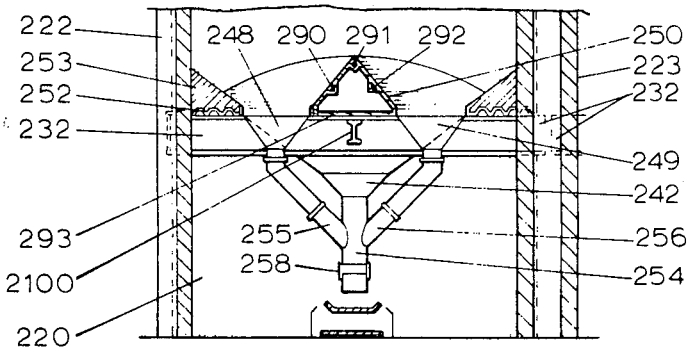
FIG. 11 is a section taken along line B—B of FIG. 10.
Figure 12:
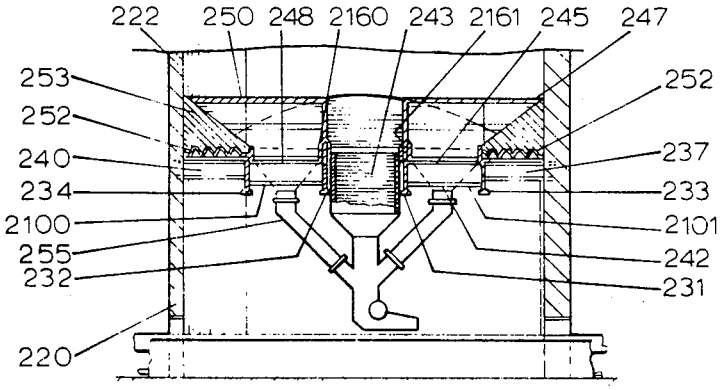
FIG. 12 is a section taken along line C—C of FIG. 11.

The hoppers 120, 121 and 122 in the main storage bins are identical in construction to the hoppers in the main storage bins of my copending application; and the hoppers in the interstitial and star bins 119 and 118, respectively, are of identical structure to the hoppers in the corresponding bins in the same copending application, as illustrated in FIGS. 10–12. The fragmentary plan view of FIG. 10 illustrates the individual structures of these hoppers, and this is characteristic of the structure at each level.

Between counterplanes 222 and 223, two beams 231 and 232 extend in parallel relationship equidistant from the diameter. Outward of each of these beams, further beams 233 and 234 extend in parallel relationship in the manner shown. Beams 233 and 234 are in turn provided with support by beams 236, 237 and 238, and 239, 240 and 241, respectively. Each beam is seated on a bearing plate.

A central hopper 242 with downwardly extending wing plates 243 and 244 is connected to and supported between beams 231 and 232. Beams 232 and 234 support a pair of smaller spaced apart hoppers 248 and 249, and a baffle 250, between and supported on plate 293 and beam 2100, guides materials toward the respective hoppers. It will be evident that the provision of angles 290, 291, and 292 provides additional strength to baffle 250. Beams 231 and 233 similarly support hoppers 245 and 246 and baffle 247. Baffle 247 has the same construction as baffle 250 and, as indicated at 251, is supported by beam 2101.

Within the inner wall face of the silo, a steel forming deck 252 is mounted on steel beams, and a concrete beam 253 is poured. This concrete beam is provided with inclined upper surfaces to guide the material into the hoppers as illustrated, and the inclines on the various surfaces are indicated by the directions of the arrows.

On the lower open end of each hopper, a discharge conduit is provided. From hopper 242, a main discharge conduit 254 extends downward and, from each of the side hoppers, auxiliary conduits 255, 256 and 257 extend and join the main discharge conduit 254. At the lower end of conduit 254 is a suitable valve 258 provided to control the flow.

The outer space bin 228 and the star bin 227 are also provided with hoppers such as 229 and 230 respectively, and they are also supported by horizontal beams shown in dotted outline at 2102 and 2103; and 2104, 2105, 2106, 2107, 2108 and 2109, respectively.

It will be evident that the structure which has been described is capable of being built by conventional slip-form methods. However, it also provides considereable economy in that the hopper structure may be prefabricated, and the erection on site is more simple than that of prior structures. There is no necessity for the provision of any falsework or auxiliary supporting structure.

As the form proceeds vertically and reaches the hopper level, openings are provided in the silo wall to receive the wall-bearing beams 231 through 234 inclusive. These beams are then mounted in position and suitably secured together. The beams supporting the hoppers are thus horizontal load-bearing elements, and are in substantially zero hoop-tension relationship with the silo walls. Depending on the relative configuration and size of the central hopper 242, and the auxiliary hoppers 245 through 249, these may be raised above the beams prior to their mounting or between them after mounting. If raised prior to the mounting of the beams, the hoppers and their associated baffles are then simply lowered into position and secured by welding, rivetting or any other suitable means.

The steel forming deck is then laid in position and secured, and the peripheral beam 253 and any intermediate concrete baffles such as 160 and 161 poured. The conduits 255 through 257 are then secured in position. The procedure of erection for the star bin and outer space bin hoppers in the same.

The facility which the hopper structure provides in assembly constitutes a great advantage over the prior art. Each component can be prefabricated, and the size of each component permits it to be raised into any position at any height. The necessity of clumsy, expensive falsework is eliminated so that these hoppers of the present invention may be provided at any selected level as they are in the described structures.

It will of course be understood that the individual hoppers and their associated ducts or conduits, sometimes referred to collectively herein as the hopper structure, are preferably made of steel or any equivalent material.

These hoppers are similarly mounted in positions of substantially zero hoop-tension relationship and at intervals of approximately 100 feet, the total capacity of each bin being substantially triple that of a conventional bin structure. For convenience, each bin of each storage bin is identified in vertically ascending order as 112, 1122 and 1123, by way of example.

The internal opposed walls 111 of each of the inner rows of storage bins, such as 116 and 117 and 116' and 117', define the lateral walls of the workhouse or houses 123.

The floor of the workhouses 123 may be supported on transverse horizontal beams extending between and into the corresonding opposed walls 111. It will of course be understood that the structure may be of any conventional form. The workhouse roof 124 may be similarly constructed. The workhouse end walls such as 125 may be steel panels which will blow out under excess pressure to provide a measure of relief under explosive conditions.

In the embodiments shown in FIGS. 1 to 7 and 9, two workhouse structures are provided at intervals above the ground and vertically spaced from each other, immediately below the adjacent hopper levels, to permit gravity flow therebetween.

Figure 3:
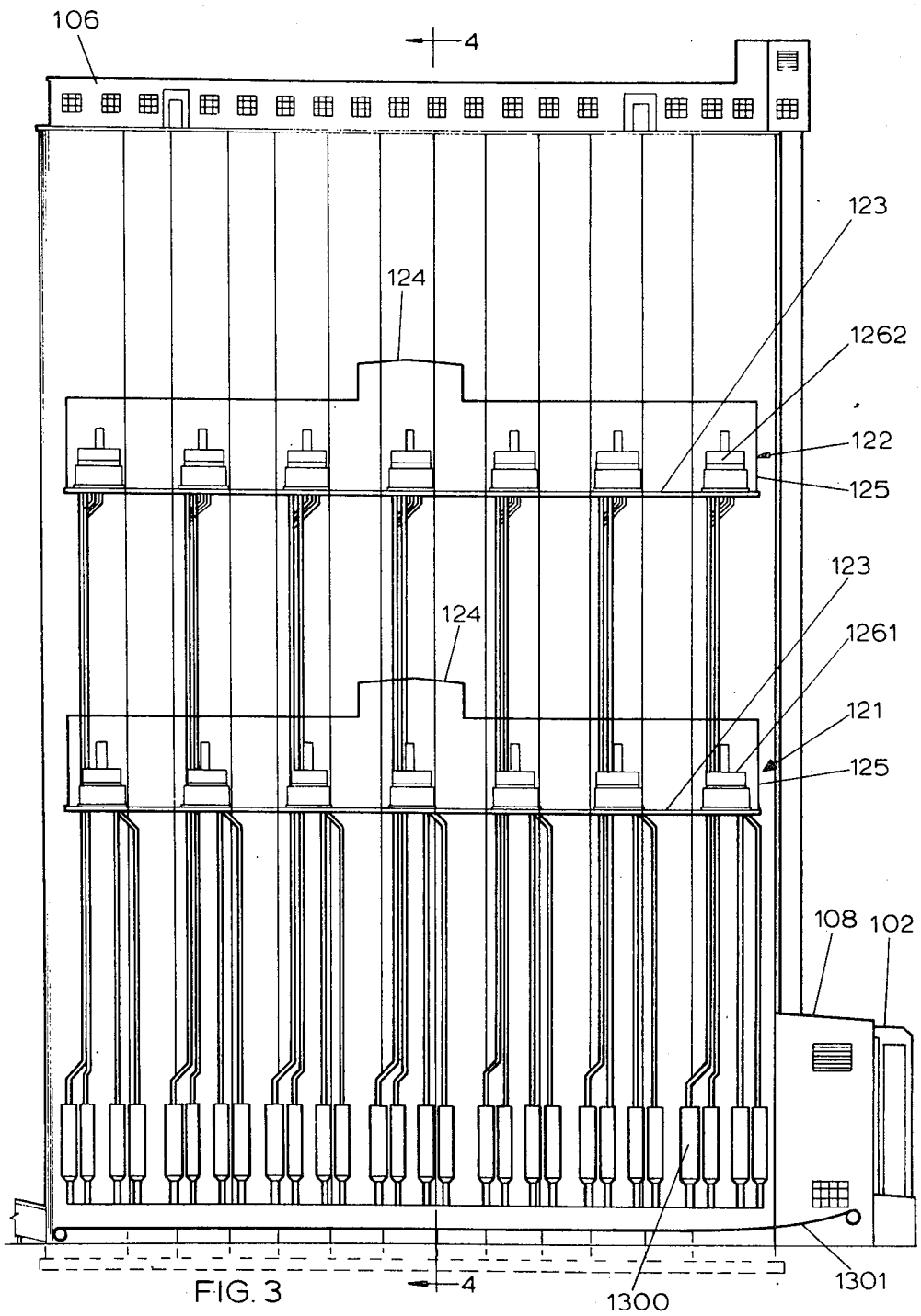
FIG. 3 is a second longitudinal elevation taken along line 3—3 of the embodiment illustrated in FIG. 1.
Figure 4:
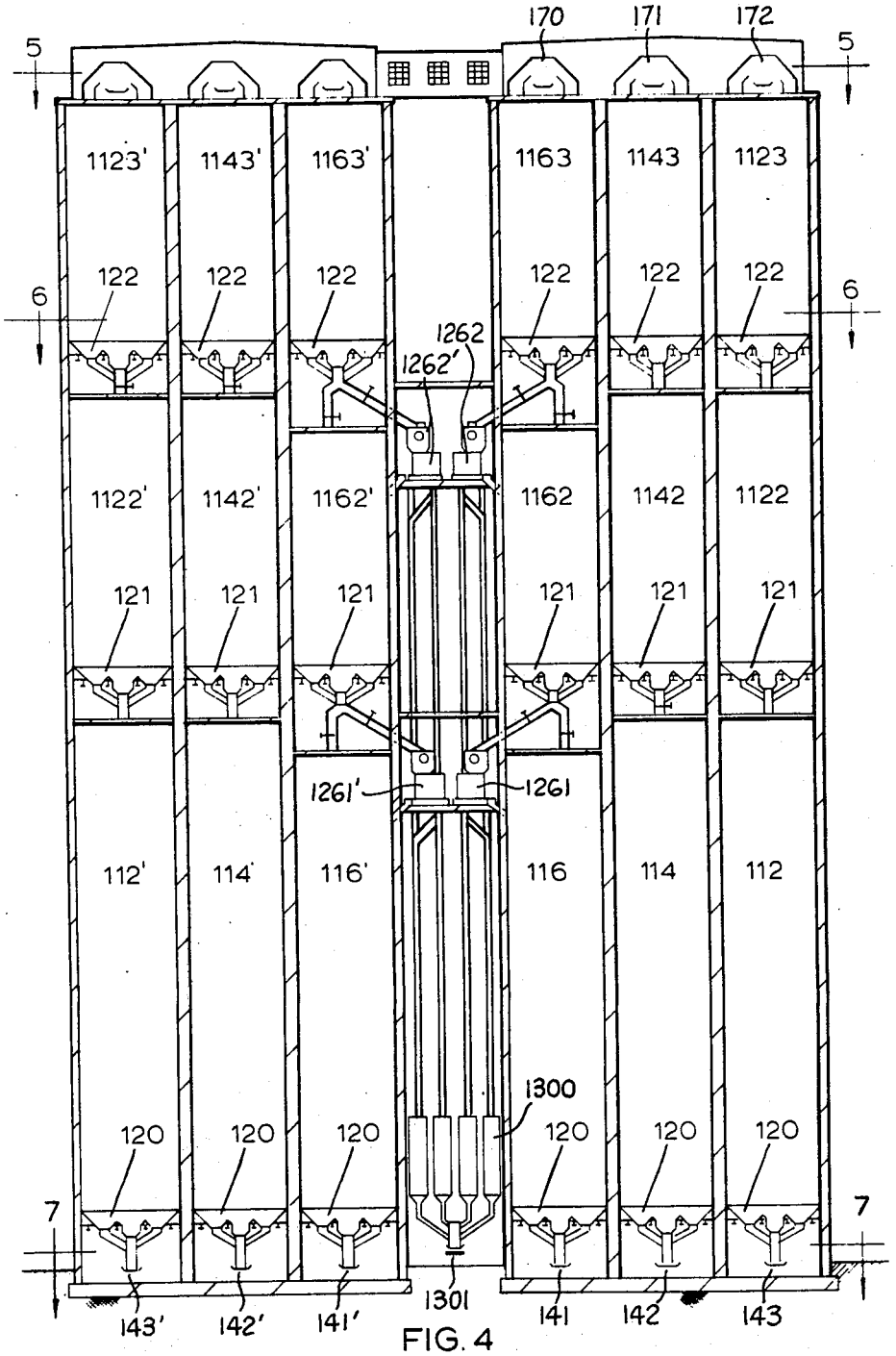
FIG. 4 is a transverse elevation taken along line 4—4 of the embodiment illustrated in FIG. 3.
Figure 5:
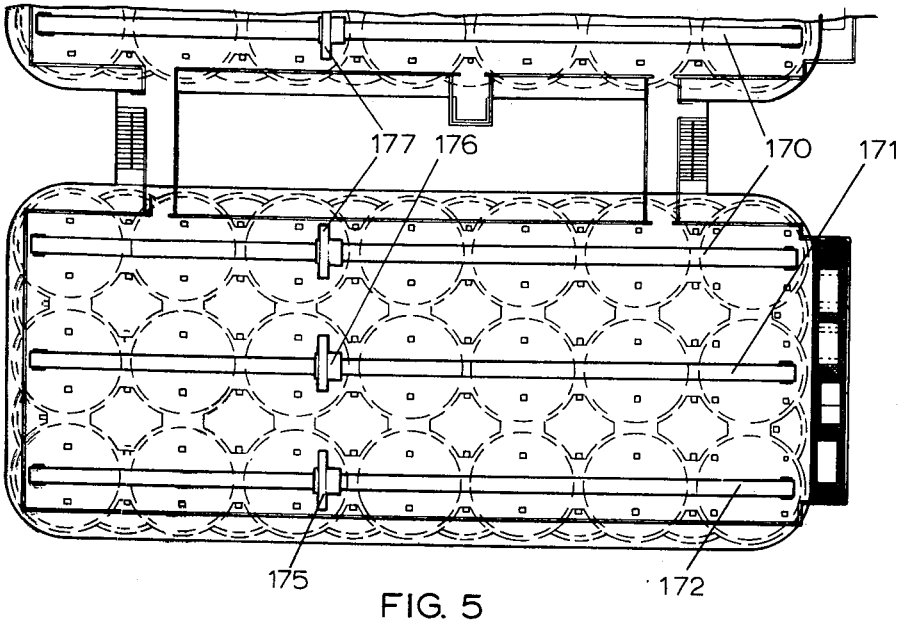
FIG. 5 is a plan view taken along line 5—5 of the embodiment illustrated in FIG. 4.
Figure 6:
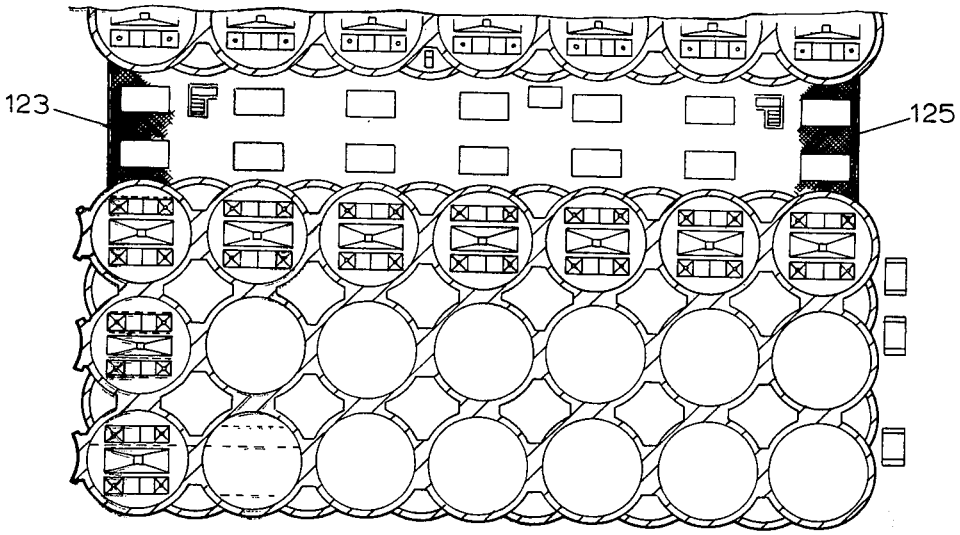
FIG. 6 is a plan view taken along line 6—6 of FIG. 4.

As illustrated in FIGS. 3 and 4, cleaning machines such as 1262' and 1262 are provided to receive the output from the upper, inner storage bins 1163' and 1163 and discharge grain into bins 1162' and 1162. Similarly cleaning machines 1261' and 1261 are provided to receive the output from bins 1162' and 1162, and discharge grain into bins 116' and 116.

The output of hoppers 122 may either be fed directly into the upper cleaning machine 1262' or to the immediate lower bin 1162'. Similarly, the output of hopper 1162' may be fed to the second cleaning machine 1261' or to the lower bin 116. The tailings of cleaning machines 1262' and 1261' are fed to cleaner tailing bins such as 1300. Those tailings may then be removed by a conveyor such as 1301.

Outward of the inner storage bins such as 116 and 117 and 116' and 117', there are as mentioned previously two parallel rows of outer bins, which are subdivided by hoppers of the structure previously referred to, to provide upper, intermediate and lower bins as in the inner described bins. However, these bins in the present embodiments communicate, when required, with the immediate lower bins, so that there will be a vertical flow under gravity when required.

Each bin is provided adjacent its lower end, below the hopper in its wall, with openings such as 140 through which conveyors 141, 142, 143, 141', 142', and 143' pass to receive and convey the output of the aligned hopper outlets.

Although not shown, separate conveyors may be provided to convey the star and interstitial bin outputs, or alternatively their output may be directed on to the previously referred to conveyors 141, 142 and 143 or 141', 142' or 143'. These conveyors are all reversible in direction.

Figure 8:
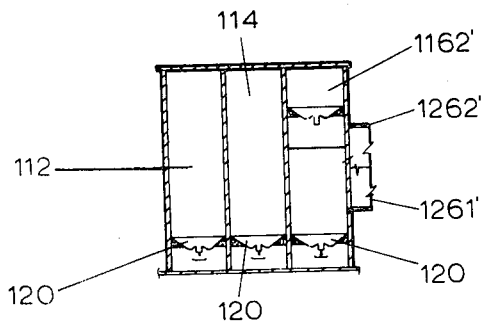
FIG. 8 is a schematic transverse elevation of one group of silos of alternate form and a workhouse showing an alternative embodiment of the present invention.
Figure 9:
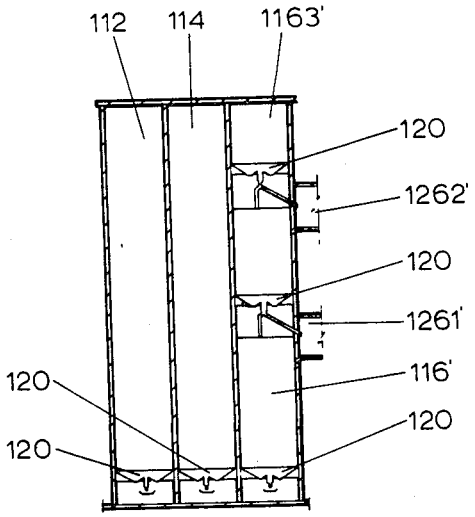
FIG. 9 is a schematic transverse elevation of a group of silos of further alternate form and a workhouse according to a further embodiment of the present invention.

In the two embodiments shown in FIGS. 8 and 9, only one hopper structure is employed adjacent the bottom of each outer bin, but the communication between the cleaners and the respective inner bins, and the outer bins and their conveyors, is substantially identical with and corresponding to the previous embodiment.

Above each group of bins, a cupola 106 is provided to protect the upper conveyors such as 170, 171 and 172. These conveyors are each provided with trippers such as 175, 176 and 177, respectively, of conventional form, to direct the conveyed material to hatch openings communicating with the upper bins.

OPERATION

The grain which arrives at the track shed is dumped onto conveyors such as 180 and 190, whence it is carried to a receiving scale jack leg 102 for conveyance to the selected storage bin row. The jack leg then raises the grain to its corresponding weigh scale, from where it is raised by its respective bucket elevator 200 to the upper conveyor. The selected upper conveyor then carries the grain and dumps it in a selected bin. If the bin selected is an inner bin such as 1163, the grain then passes through hopper 122 directly into bin 1162 or through cleaner 1262. These bins may be referred to as a primary cleaner garner bin and a secondary cleaner garner bin respectively.

From bin 1162, the grain then passes into bin 116 either directly or through cleaning machine 1261. Bin 116 may be described as a clean grain bin.

The number of cleanings to which any grain is subject will depend upon the associated dirt. If only one cleaning is necessary, then only one is performed.

If there is an immediate need for the grain, then it is shipped directly out on conveyor 141 to a shipping conveyor 300, weighed in shipping scales 104, and transferred to a shipping gallery by means of a second conveyor 301.

If there is no immediate need for the grain, then it may be stored in an outer storage bin such as 112. In such a case, conveyor 141 is reversed in direction, and the grain carried back to the receiving bucket elevator to be raised and conveyed to bin 1123. From bin 1123, it may then pass through bins 1122 and 112 to the conveyor 143 and the shipping gallery.

From the foregoing, it will be seen that the considerable expense of a conventional workhouse has been eliminated. It will also be apparent that the workhouses provided permit more flexiblity in design and layout, and are easier to maintain and operate.

It will also be apparent that, as distinct from the conventional structure which necessitated every operation being carried out in the workhouse and increased handling of the present system, the present invention eliminates the necessity of proceeding through the workhouse except during the initial cleaning.

The parallel side by side arrangement also permits both groups of silos, and for that matter both workhouses, to be operated independently with different operations, such as shipping, receiving, cleaning and recycling, being carried on simultaneously.

It must also be borne in mind that the total work now expended in raising the grain is reduced and consequently the operation is relatively more efficient.

While the present invention has been described with reference to specific embodiment, other modifications and equivalents will now be apparent to those skilled in the art, and such alternatives are within the scope of the appended claims.

What I claim is:

1. A storage unit for granular material which comprises:

a. a generally planar base structure;

b. a first wall structure extending upwardly from said base to define connected vertical sidewalls of at least one row of first generally cylindrical bins;

c. a second wall structure extending upwardly from said base to define connected vertical sidewalls of at least one row of second generally cylindrical bins, spaced apart from and parallel to said first bins;

d. first hopper means mounted adjacent the lower end of each of said bins to define the respective bottom ends thereof; and second hopper means mounted on said vertical wall in a spaced apart relationship above said first hopper means to define upper and lower bins, said first and second hopper means each having discharge control means aligned one with the other;

e. each said hopper means having substantially horizontal load-bearing elements mounted in substantially zero hoop-tension relationship with said vertical walls;

f. wall openings in each of said vertical walls aligned with said discharge control means to define a conveyor passageway;

g. lower conveyor means extending through said passage to receive and convey material discharged from said bins to an outgoing weigh station;

h. an in-going weigh station;

i. elevator means for raising material from said ingoing weigh station to said bin tops;

j. upper conveyor means for conveying said material from said elevator means to a selected one of said bins; and k. cleaning means disposed between opposed vertical sidewalls of said first and second rows of bins and communicable with said upper and lower bins thereof.

2. A storage unit according to claim 1 wherein said cleaning means is disposed at an elevated level above said first hopper means and below said second hopper means, said discharge control means of said second hopper means being operable to discharge material from the upper bins to said cleaning means, and means for directing the flow of material from said cleaning means into said lower bins.

3. A storage unit according to claim 2 wherein said cleaning means is located in an elevated workhouse integral with said first and second wall structures.

4. A storage unit as claimed in claim 1 wherein said cleaning means is disposed on a level below said upper hopper means.

5. A storage unit as claimed in claim 1, wherein said first and second wall structures further define a plurality of outer rows of bins.

6. A storage unit as claimed in claim 5, wherein said outer rows of bins each include at least one hopper means including a discharge control mounted adjacent the bottom end thereof; said vertical walls each having an opening therein below said hopper means, and conveyor means extending through said openings to receive and transfer material received therefrom.

7. A storage unit as claimed in claim 6, wherein said outer rows of bins each include further hopper means mounted above said first-mentioned hopper means in a vertically spaced apart relationship therefrom to define upper and lower bins; said further hopper means each including a discharge control means for controlling the flow of said material from said upper to said lower bins.

8. A storage unit as claimed in claim 5 wherein said conveyor means is reversible in direction.

9. A storage unit for granular material which comprises:

a. a generally planar basal structure;

b. a first wall structure extending upwardly to define connected vertical sidewalls of an inner row of aligned storage bin structures and a plurality of outer parallel rows of vertical generally cylindrical storage bin structures, and a second plurality of parallel rows of vertical generally cylindrical storage bin structures spaced apart from and parallel to said first plurality of parallel rows; said second plurality of parallel rows having an inner row of storage bin structures and a plurality of outer parallel rows of vertical walls of said storage bin structures further defining interstitial bins;

c. a plurality of hopper means mounted in each storage bin and interstitial bin in a vertical spaced apart relationship from each other to define at least one lower bin and one upper bin in each storage bin and interstitial bin;

d. each said hopper means having substantially horizontal load-bearing elements mounted in substantially zero hoop-tension relationship with said vertical walls; and e. first cleaning means disposed between said adjacent inner rows of storage bins below an upper hopper means and an upper one of said storage bins; flow control means for controlling the rate and direction of flow from said upper storage bins of said inner storage structures to a selected one of said cleaning means or an adjacent lower storage bin; and means directing the flow of said material from said first cleaning means to a selected one of said lower storage bins.

10. A storage unit as claimed in claim 7 further including second cleaning means disposed below a second upper storage bin, said cleaning means being communicable with a lower storage bin.

* * * * *